US008449411B2

(12) United States Patent
LeVault et al.

(10) Patent No.: US 8,449,411 B2
(45) Date of Patent: May 28, 2013

(54) RACQUET HANDLE ASSEMBLY INCLUDING A PLURALITY OF SUPPORT MEMBERS

(75) Inventors: Gerald J. LeVault, Addison, IL (US); Ronald R. Rocchi, Naperville, IL (US); William D. Severa, Darien, IL (US); Robert T. Kapheim, Elmhurst, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 13/207,652

(22) Filed: Aug. 11, 2011

(65) Prior Publication Data

US 2013/0040768 A1 Feb. 14, 2013

(51) Int. Cl.
*A63B 49/08* (2006.01)

(52) U.S. Cl.
USPC ..... 473/549; 473/538

(58) Field of Classification Search
USPC ..... 473/523, 549, 551, 537, 538
See application file for complete search history.

(56) References Cited

U.S. PATENT DOCUMENTS

| | | | | |
|---|---|---|---|---|
| 1,563,780 | A | 12/1925 | Ovenshire | 473/521 |
| 1,583,309 | A | 5/1926 | Reach | 473/545 |
| 1,601,209 | A | 9/1926 | Geyer | 29/469 |
| 1,750,644 | A | 3/1930 | Norton | 473/549 |
| 1,897,515 | A | 2/1933 | Hedstrom | 403/376 |
| 2,211,502 | A | 8/1940 | Bayliffe | 473/548 |
| 2,280,382 | A | 4/1942 | Davis | 473/549 |
| 2,753,186 | A | 7/1956 | Kleinman | 473/551 |
| 3,203,697 | A | 8/1965 | Berzatzy | 473/538 |
| 3,501,148 | A | 3/1970 | Cheris et al. | 473/545 |
| 3,534,960 | A | 10/1970 | Hanks | 473/551 |
| 3,540,728 | A | 11/1970 | Palmer | 473/545 |
| 3,545,755 | A | 12/1970 | Owada | 473/526 |
| 3,582,072 | A | 6/1971 | Stueck | 473/545 |
| 3,633,910 | A | 1/1972 | Spenle | 473/545 |
| 3,638,943 | A | 2/1972 | Snauwaert | 473/549 |
| 3,833,219 | A | 9/1974 | Dean | 473/523 |
| 3,931,968 | A | 1/1976 | Hedberg | 473/552 |
| 3,948,519 | A | 4/1976 | Portz et al. | 473/549 |
| 4,015,851 | A | 4/1977 | Pennell | 473/549 |
| 4,072,311 | A | 2/1978 | Bertucci | 473/551 |
| 4,077,627 | A | 3/1978 | Cheatham et al. | 473/531 |
| 4,082,204 | A | 4/1978 | Savage | 222/191 |
| 4,082,276 | A | 4/1978 | Szafianski | 473/550 |
| 4,099,718 | A | 7/1978 | Marks | 473/536 |
| 4,131,278 | A | 12/1978 | Goldenberg | 473/526 |
| 4,139,195 | A | 2/1979 | Dreesen et al. | 473/550 |
| 4,161,813 | A | 7/1979 | Robinson | 29/460 |
| 4,180,264 | A | 12/1979 | Robinson | 473/549 |
| 4,247,975 | A | 2/1981 | Robinson | 473/551 |
| 4,283,818 | A | 8/1981 | Kinard et al. | 29/76.1 |
| 4,351,529 | A | 9/1982 | Schultz et al. | 473/549 |
| 4,374,589 | A | 2/1983 | Strickland | 473/538 |
| 4,400,892 | A | 8/1983 | Tebaldi | 34/95.1 |

(Continued)

*Primary Examiner* — Raleigh W Chiu
(74) *Attorney, Agent, or Firm* — Terence P. O'Brien

(57) ABSTRACT

A sports racquet including a handle assembly coupled to and longitudinally extending from a head portion. The handle assembly includes an elongate tubular shaft, a pallet positioned over the shaft, and a plurality of generally planar support members. The pallet is positioned over the shaft and has an outer surface that defines a plurality of longitudinally extending flats. Each of the flats has a length and a width. At least two of the flats define respective elongate recesses. Each of the recesses having a maximum recess width that is less than the width of the respective flat. The support members are positioned within the respective recesses.

26 Claims, 7 Drawing Sheets

U.S. PATENT DOCUMENTS

| | | | | | |
|---|---|---|---|---|---|
| 4,407,500 | A | | 10/1983 | Hofmann | 473/550 |
| 4,441,713 | A | | 4/1984 | Van Dyck et al. | 473/545 |
| 4,545,584 | A | | 10/1985 | Adam | 473/552 |
| 4,565,371 | A | | 1/1986 | Pawlicki et al. | 473/547 |
| 4,570,358 | A | | 2/1986 | Sacerdote | 34/569 |
| 4,583,734 | A | | 4/1986 | Pawlicki et al. | 473/524 |
| 4,609,198 | A | | 9/1986 | Tarr | 473/523 |
| 4,641,838 | A | | 2/1987 | Gabrielidis | 473/552 |
| 4,655,449 | A | | 4/1987 | Chamness | 473/549 |
| 4,693,475 | A | | 9/1987 | Keilhau | 473/552 |
| 4,709,925 | A | | 12/1987 | Gatlin | 473/463 |
| 4,743,021 | A | | 5/1988 | Gonzales, Jr. | 473/526 |
| 4,796,889 | A | | 1/1989 | Muraour | 473/549 |
| 4,836,544 | A | | 6/1989 | Lai | 473/551 |
| 4,854,596 | A | | 8/1989 | Carbonetti | 473/551 |
| 4,890,848 | A | | 1/1990 | Hayes et al. | 473/550 |
| 4,936,586 | A | | 6/1990 | Van Raemdonck | 473/519 |
| 4,964,645 | A | | 10/1990 | Lai | 473/551 |
| 4,984,793 | A | | 1/1991 | Chen | 473/519 |
| 4,988,100 | A | | 1/1991 | Shu et al. | 473/531 |
| 5,000,452 | A | | 3/1991 | Kuebler | 473/549 |
| 5,069,452 | A | | 12/1991 | Chen | 473/549 |
| 5,088,734 | A | * | 2/1992 | Glava | 473/523 |
| 5,092,594 | A | | 3/1992 | Jang | 473/523 |
| 5,131,652 | A | | 7/1992 | Peng | 473/523 |
| 5,135,223 | A | * | 8/1992 | You | 473/523 |
| 5,158,287 | A | | 10/1992 | Janes | 473/537 |
| 5,199,706 | A | | 4/1993 | Chen | 473/549 |
| 5,269,516 | A | * | 12/1993 | Janes | 473/523 |
| 5,275,407 | A | | 1/1994 | Soong | 473/549 |
| 5,282,913 | A | | 2/1994 | Lo | 156/185 |
| 5,295,684 | A | | 3/1994 | Bracho | 473/549 |
| 5,316,316 | A | | 5/1994 | Lai | 473/538 |
| 5,322,278 | A | | 6/1994 | Jeanrot | 473/521 |
| 5,322,280 | A | | 6/1994 | Wu | 473/523 |
| 5,326,098 | A | | 7/1994 | Ou et al. | 473/549 |
| 5,335,919 | A | | 8/1994 | Soong | 473/551 |
| RE34,767 | E | | 10/1994 | Soong | 473/300 |
| 5,409,216 | A | | 4/1995 | Brown | 473/552 |
| 5,425,534 | A | | 6/1995 | Chen | 473/549 |
| 5,472,190 | A | | 12/1995 | Norling | 473/463 |
| 5,485,996 | A | | 1/1996 | Niksich | 473/549 |
| 5,492,324 | A | | 2/1996 | Hagey | 473/551 |
| 5,516,101 | A | | 5/1996 | Peng | 473/523 |
| 5,524,879 | A | | 6/1996 | Lyle | 473/552 |
| 5,551,690 | A | | 9/1996 | Brown | 473/538 |
| 5,599,019 | A | * | 2/1997 | Davis et al. | 473/549 |
| 5,618,041 | A | | 4/1997 | Huang | 473/549 |
| 5,624,116 | A | | 4/1997 | Yeh | 473/538 |
| 5,641,162 | A | | 6/1997 | Brown | 473/552 |
| 5,645,501 | A | | 7/1997 | Huang | 473/549 |
| 5,669,835 | A | | 9/1997 | Tiura | 473/550 |
| 5,690,566 | A | | 11/1997 | Bracho | 473/549 |
| 5,695,418 | A | | 12/1997 | Huang | 473/549 |
| 5,711,720 | A | * | 1/1998 | Janes et al. | 473/300 |
| 5,730,669 | A | | 3/1998 | Huang | 473/549 |
| 5,749,798 | A | | 5/1998 | Kuebler et al. | 473/549 |
| 5,762,572 | A | | 6/1998 | Chuang | 473/551 |
| 5,795,254 | A | | 8/1998 | Brown | 473/552 |
| 5,816,960 | A | | 10/1998 | Svoma et al. | 473/549 |
| 5,857,929 | A | | 1/1999 | Huang | 473/549 |
| 5,860,878 | A | | 1/1999 | You | 473/549 |
| 5,865,694 | A | | 2/1999 | Duong-Van | 473/520 |
| 5,924,941 | A | | 7/1999 | Hagey | 473/551 |
| 5,931,748 | A | | 8/1999 | Hsieh | 473/523 |
| 5,931,749 | A | | 8/1999 | Hagey | 473/551 |
| 6,017,283 | A | | 1/2000 | Hagey | 473/551 |
| 6,033,325 | A | | 3/2000 | Hong | 473/552 |
| 6,071,203 | A | | 6/2000 | Janes et al. | 473/535 |
| 6,086,489 | A | | 7/2000 | Hsu | 473/549 |
| 6,089,996 | A | | 7/2000 | Hsu | 473/523 |
| 6,106,418 | A | | 8/2000 | Hagey et al. | 473/551 |
| 6,149,538 | A | * | 11/2000 | Tiura | 473/550 |
| 6,159,115 | A | | 12/2000 | Hsu | 473/549 |
| 6,213,902 | B1 | | 4/2001 | Hagey et al. | 473/551 |
| 6,234,920 | B1 | | 5/2001 | Wang | 473/523 |
| 6,270,434 | B1 | | 8/2001 | Shaw | 473/553 |
| 6,435,991 | B1 | | 8/2002 | Kishek | 473/551 |
| 6,471,607 | B2 | | 10/2002 | Hsu | 473/523 |
| 6,485,381 | B1 | | 11/2002 | Pai | 473/521 |
| 6,511,732 | B1 | | 1/2003 | Chao | 428/138 |
| 6,663,515 | B1 | | 12/2003 | Pai | 473/521 |
| 6,685,583 | B2 | * | 2/2004 | Severa et al. | 473/549 |
| 6,800,239 | B2 | | 10/2004 | Davis | 264/516 |
| 6,840,874 | B2 | | 1/2005 | Severa et al. | 473/521 |
| 6,935,975 | B2 | | 8/2005 | Chang et al. | 473/549 |
| 7,297,080 | B2 | | 11/2007 | Severa et al. | 473/536 |
| 7,651,419 | B2 | | 1/2010 | Brunner | 473/523 |
| 2003/0100389 | A1 | * | 5/2003 | Severa et al. | 473/549 |
| 2003/0195065 | A1 | * | 10/2003 | Davis | 473/549 |
| 2004/0204270 | A1 | * | 10/2004 | Chang et al. | 473/549 |

* cited by examiner

RACQUET HANDLE ASSEMBLY INCLUDING A PLURALITY OF SUPPORT MEMBERS

RELATED APPLICATION

The present application is related to co-pending U.S. patent application Ser. No. 13/207,667, filed on the same day herewith by Gerald J. LeVault, Ronald R. Rocchi, William D. Severa and Robert T. Kapheim entitled RACQUET HANDLE ASSEMBLY INCLUDING A PLURALITY OF SUPPORT MEMBERS, the full disclosure of which are hereby incorporated by reference.

FIELD OF THE INVENTION

The present invention relates generally to a sports racquet. In particular, the present invention relates to racquet including an improved handle assembly having a plurality of support members.

BACKGROUND OF THE INVENTION

Sport racquets, such as tennis, racquetball, squash and badminton racquets, are well known and typically include a frame having a head portion coupled to a handle portion. The head portion supports a string bed having a plurality of main string segments interwoven with a plurality of cross string segments. Many racquets also include a throat portion positioned between and connecting the handle portion to the head portion. The handle assembly typically includes a shaft, a pallet and a grip. The pallet is typically positioned over the shaft and is commonly formed of a hard material, such as a structural polyurethane foam. The grip is typically helically wrapped about, and attached to, the pallet through the use of an adhesive. The handle assembly typically is formed with a generally octagonal transverse cross-sectional shape that produces eight elongate, generally planar regions along the length of the handle assembly. These generally planar regions are commonly referred to as flats. The eight flats are positioned adjacent each other and form eight elongate corners or ridges, which collectively produce the handle assembly's generally octagonal shape.

It is not uncommon for a substantial amount of shock and vibration to be generated from the racquet upon striking a ball, particularly where the point of the impact occurs away from a central region of the racquet head, commonly referred to as the "sweet spot." Such impacts typically create a shock wave or vibration that travels from the string bed, to the racquet head portion, up the handle assembly, and to the hand, arm and shoulder of the user. This shock and vibration can be harsh, uncomfortable, and even harmful, to certain users. At a minimum, the shock and vibration can negatively affect the user's feel of the racquet and can provide the user with a negative impression of the racquet. Although the grip provides some cushioning or dampening effect, the grip alone does not substantially reduce the shock and vibration felt by the user.

Players typically use the flats and/or the corners to position their hand, hands or finger tips into the desired grip position or positions on the handle assembly. During play, many players will use two or more different grip positions for impacting the ball. For example, a player may use one grip position for hitting a forehand shot with a racquet, a second grip position for hitting a back hand shot, and a third grip position when serving. Further, when switching from one grip position to another, many more experienced players will complete the switch of grip positions without looking at the handle assembly or their hands. Such players, will typically rely on feel, and in particular, the feel of their fingertips or palm on one or more of the flats and/or corners of the grip assembly. Grip assemblies that are made with excessive cushioning material tend to lose the octagonal shape and result in a more cylindrical shape with a more circular or oval cross-sectional shape. Such grip assemblies make switching between grip positions very difficult without forcing the player to look at his or her racquet and grip on it. When a player looks to his or her grip to confirm proper grip position, he or she is taking his or her eyes off the ball, and his or her performance can be negatively affected by the lack of attention paid to the ball in play.

Thus, there is a continuing need for a racquet with an improved handle assembly that can further reduce the shock and vibration felt by a user during play, while not negatively affecting the player's ability to use the flats and corners of the handle assembly to properly and quickly change grip positions during play. What is also needed is an improved handle assembly that improves the feel of the racquet, without negatively affecting the playability of the racquet. There is also a need for a racquet having an improved handle assembly that is not a radical departure in look and design from traditional sport racquet designs.

SUMMARY OF THE INVENTION

The present invention provides a sports racquet for impacting a game ball. The sports racquet includes a handle assembly coupled to and longitudinally extending from a head portion. The handle assembly includes an elongate tubular shaft, a pallet positioned over the shaft, and a plurality of generally planar support members. The pallet is positioned over the shaft and has an outer surface that defines a plurality of longitudinally extending flats. Each of the flats has a length and a width. At least two of the flats define respective elongate recesses. Each of the recesses having a maximum recess width that is less than the width of the respective flat. The support members are positioned within the respective recesses.

According to a principal aspect of a preferred form of the invention, a handle assembly for a sports racquet includes an elongate tubular shaft, a pallet positioned over the shaft, and at least four planar support members. The pallet has an outer surface that defines at least four longitudinally extending flats. Each of the flats has a width and a length. At least four of the flats define respective elongate recesses. Each of the recesses has a recess length and a recess maximum width. The maximum recess width of each of the recesses is less than the width of the respective flat.

According to another preferred aspect of the invention, a sports racquet for impacting a game ball includes a head portion and a handle assembly coupled to and longitudinally extending from the head portion. The handle assembly includes an elongate tubular shaft, a pallet positioned over the shaft, and a plurality of support members. The pallet defines a plurality of longitudinally extending planar regions and a plurality of longitudinally extending recesses. The recesses are respectively positioned between two of the plurality of planar regions. The support members are positioned within the respective recesses. Each of the support members has an outer surface that forms an elongated corner. The handle assembly has an outer surface that includes a plurality of longitudinally extending flats and a generally polygonal-shaped transverse cross-sectional area, wherein each of the plurality of planar regions forms at least part of a separate one of the plurality of flats.

According to another preferred aspect of the invention, a handle assembly for a sports racquet having a head portion. The handle assembly includes an elongate tubular shaft, a pallet positioned over the shaft, and a plurality of support members. The pallet defines a plurality of longitudinally extending planar regions and a plurality of longitudinally extending recesses. The recesses are respectively positioned between two of the plurality of planar regions. The support members are positioned within the respective recesses. Each of the support members has an outer surface that forms an elongated corner. The handle assembly has an outer surface that includes a plurality of longitudinally extending flats and a generally polygonal-shaped transverse cross-sectional area, wherein each of the plurality of planar regions forms at least part of a separate one of the plurality of flats. The handle assembly is coupled to and longitudinally extends from the head portion.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
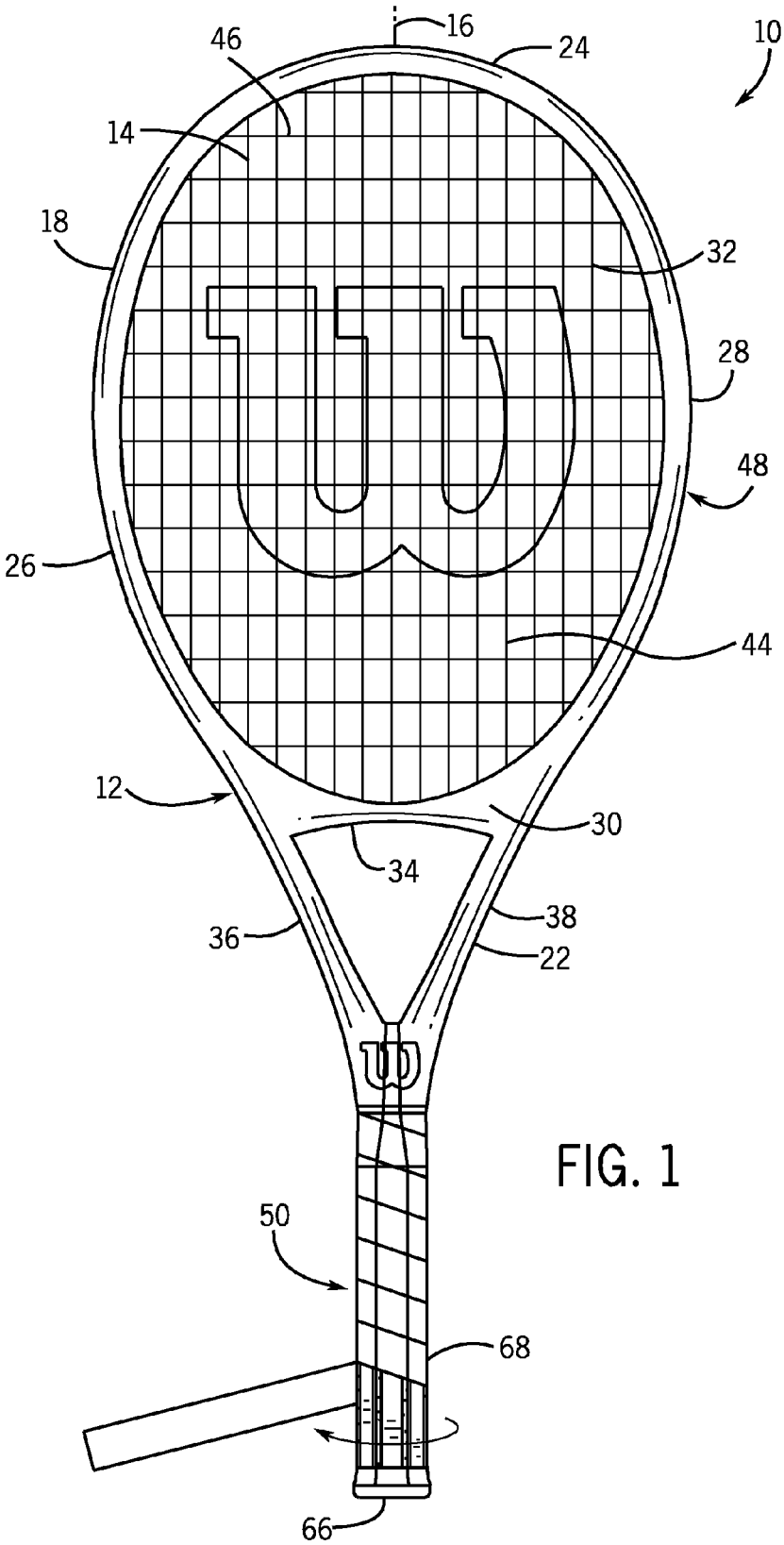
FIG. 1 is a front side view of a racquet in accordance with a preferred embodiment of the present invention with the grip partially removed from the racquet.

Referring to FIG. 1, a sports racquet is indicated generally at 10. The racquet 10 of FIG. 1 is configured as a tennis racquet, however, the invention can also be formed as other types of sports racquets, such as, for example, a racquetball racquet, a squash racquet, or a badminton racquet. The racquet 10 includes a frame 12 and a string bed 14. The frame 12 is a tubular structure having a longitudinal axis 16 and including a head portion 18, a handle portion 20, and a throat portion 22 coupling the head and handle portions 18 and 20. The frame 12 is formed of a lightweight, durable material, preferably a carbon-fiber composite material. As used herein, the term "composite material" refers to a plurality of fibers impregnated (or permeated throughout) with a resin. The fibers can be co-axially aligned in sheets or layers, braided or weaved in sheets or layers, and/or chopped and randomly dispersed in one or more layers. The composite material may be formed of a single layer or multiple layers comprising a matrix of fibers impregnated with resin. In particularly preferred embodiments, the number layers can range from 3 to 8. In multiple layer constructions, the fibers can be aligned in different directions with respect to the longitudinal axis 24, and/or in braids or weaves from layer to layer. The fibers are formed of a high tensile strength material such as graphite. Alternatively, the fibers can be formed of other materials such as, for example, glass, carbon, boron, basalt, carrot, Kevlar®, Spectra®, poly-para-phenylene-2, 6-benzobisoxazole (PBO), hemp and combinations thereof. In one set of preferred embodiments, the resin is preferably a thermosetting resin such as epoxy or polyester resins. In other sets of preferred embodiments, the resin can be a thermoplastic resin. The composite material is typically wrapped about a mandrel and/or a comparable structure, and cured under heat and/or pressure. While curing, the resin is configured to flow and fully disperse and impregnate the matrix of fibers.

Alternatively, the frame 12 can be formed of other materials including aluminum, metallic alloys, other composite materials, wood, or combinations thereof. The head portion 18 forms a distal region 24, first and second side regions 26 and 28, and a proximal region 30, which collectively define a string bed area 32 for receiving and supporting the string bed 14. In one preferred embodiment, the proximal region 30 includes a yoke 34.

The yoke 34 is an elongate tubular structural member which extends from the first side region 26 to the second side region 28 of the head portion 18. In one preferred embodiment, the yoke 34 is integrally formed with the frame 12 defining the proximal region 30. In alternative preferred embodiments, the yoke 34 can be connected through use of adhesives, fasteners, bonding and combinations thereof. In another embodiment, the yoke 34 can separated from the frame 12 by vibration absorbing material, such as, for example, an elastomer. In an alternative preferred embodiment, the frame 12 of the racquet 10 can be formed without a yoke.

In a preferred embodiment, the first and second side regions 26 and 28 downwardly extend from the head portion 18 to form first and second throat tubes 36 and 38 of the throat portion 22. The first and second throat tubes 36 and 38 converge further downwardly extend to form the handle portion 20.

In another preferred embodiment, the head portion 18 is directly connected to one or both of the throat portion 22 and the yoke 34 through the use of conventional fasteners, adhesives, mechanical bonding, thermal bonding, or other combinations thereof. Alternatively, the head portion 18 can be separated from one or both of the throat portion and the yoke by a vibration and shock absorbing material, such as an elastomer. In yet another alternative preferred embodiment, the head portion 18 is integrally formed with one or both of the throat portion 22 and the yoke 16.

The string bed 14 is formed by a plurality of main string segments 44 interwoven with a plurality of cross string segments 46. The main and cross string segments 44 and 46 can be formed from one continuous piece of racquet string, or from two or more pieces of racquet string. The head portion 18 of the racquet 10 is preferably a tubular structure shaped to define a hoop 48. The hoop 48 can be any closed curved shape including, for example, a generally oval shape, a generally tear-drop shape, a generally pear shape, a generally circular shape and combinations thereof.

Figure 2:
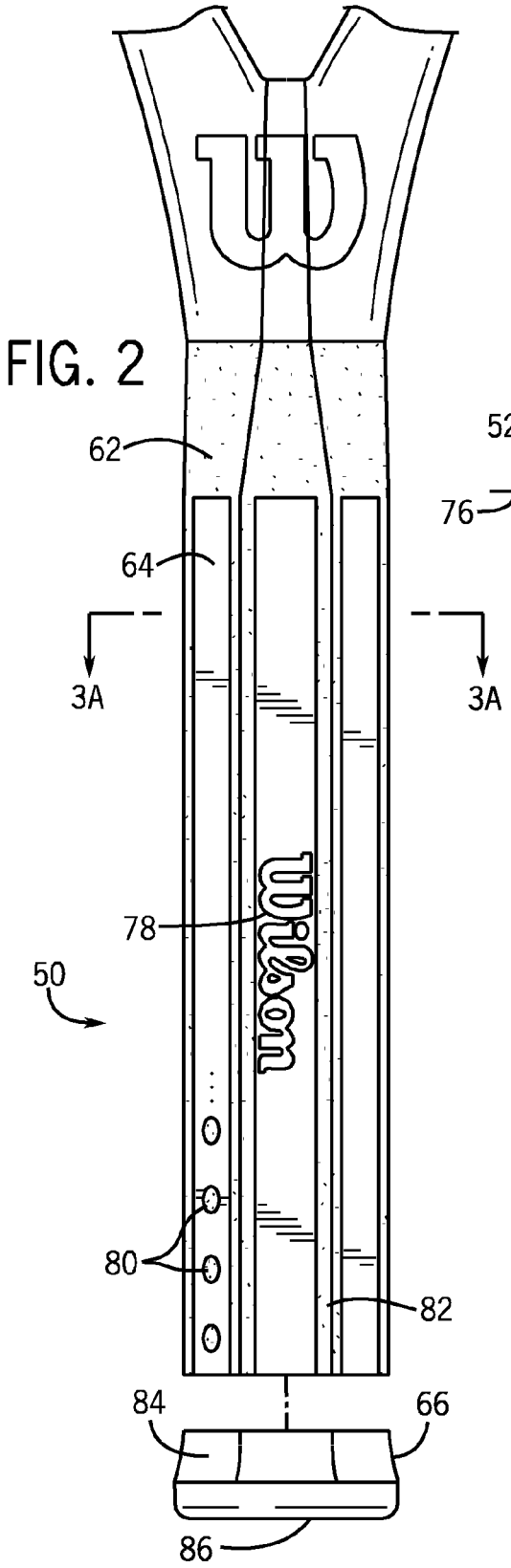
FIG. 2 is a side view of the handle assembly and throat portion of the racquet of FIG. 1 with the grip and butt cap removed from the handle assembly.
Figure 3:
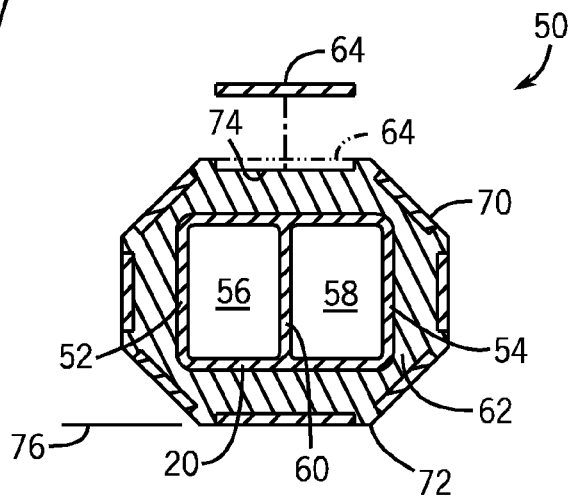
FIG. 3 is a transverse cross-sectional view of the handle assembly taken along line 3-3 of FIG. 2.
Figure 4:
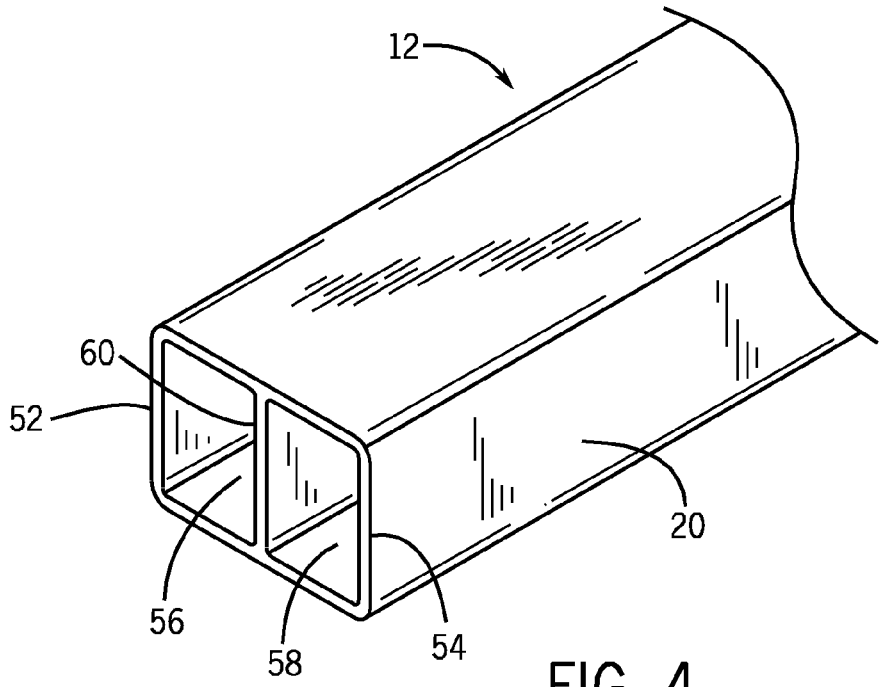
FIG. 4 is a side, end perspective view of a shaft of the handle assembly of the racquet of FIG. 1.

Referring to FIGS. 2 through 4, the handle portion 20 of the frame 12 is shown. The handle portion of the frame 12 is also referred to as the shaft 20 or as the "hairpin", and the shaft 20 forms part of a handle assembly 50. The shaft 20 is an elongate tubular structure that is preferably integrally formed to the frame 12 of the racquet 10. The shaft 20 provides structural support to the handle assembly 50. In one particularly preferred embodiment, the shaft 20 as part of the frame 12 is formed of a composite material that is an extension of the composite material used to form the hoop portion 18 of the frame 12. The composite material can be wrapped around a mandrel or a tube and shaped typically in a mold into the hoop portion 18 with the pair of end sections 52 and 54 of the composite material being positioned next to each other at the shaft 20. The pair of end sections 52 and 54 form a pair of generally parallel tubular cavities 56 and 58. The mold can be configured to shape the outer surface of the shaft 20 into a desired shape. In one preferred embodiment, the shaft 20 can be configured with an outer surface that has a generally rectangular transverse cross-sectional area. After molding, the pair of end sections 52 and 54 form a common inner wall 60 that longitudinally extends along the shaft 20. The inner wall 60 further strengthens the structure of the shaft 20. In alternative preferred embodiments, the outer surface of the shaft can be formed to have other transverse cross-sectional shapes, such as, for example, other polygonal shapes, circular, oval, ellipsoid, irregular shapes and combinations thereof. The tubular cavities 56 and 58 can be hollow or can be filled or partially filled with a material, such as a cellular foam to adjust the weight of the racquet and/or to dampen the sound during use, and/or to dampen vibration of the racquet during play.

The shaft 20 is preferably integrally formed as part of the frame 12 with the hoop portion 18 as a one-piece structure. In alternative preferred embodiments, the shaft 20 can be formed as a separate component from the hoop portion, and then coupled together. The shaft can be coupled to the hoop portion through the use of intermediate pieces such as a throat portion, conventional fasteners, molding techniques, bonding techniques, adhesives or combinations thereof.

Referring to FIGS. 1 through 3, the handle assembly 50 further includes a pallet 62, a plurality of support members 64, a butt cap 66 and a grip 68. The pallet 62 is a tubular structure that surrounds the shaft 20 and typically defines the general shape of the handle assembly 50. The pallet 62 is preferably formed of a light weight, durable, shock absorbing and vibration dampening material, such as a two-part polyurethane cellular foam material. Alternatively, the pallet can be formed of other durable, shock-absorbing and vibration dampening materials such as, for example, other cellular foam materials, non-cellular foam materials, wood, a thermoplastic material, a thermoset material, neoprene, rubber, silicon, a composite material, a metal and combinations thereof. The pallet 62 is preferably fixedly secured to the shaft 20 as a two-part foam that bonds to the shaft 20. Alternatively, the pallet 62 can be secured to the shaft 20 through thermal bonding, chemical bonding, fasteners, interference fits, snap-fit connections, and combinations thereof. The pallet 62 can be molded and formed over the shaft 20, or pre-formed and secured to the shaft 20. The pallet 62 can be formed in a variety of single colors or in multiple color combinations. The pallet 62 preferably has a length that extends approximately 20 to 30 percent of the length of an entire racquet. For example, a racquet having a total length of 27 inches can have a pallet 62 with a length of approximately 7 inches. In a preferred embodiment, the pallet 62 has a length between 5.0 and 9.5 inches; and, in a particularly preferred embodiment, the pallet 26 has a length of approximately 7.0 to 8.0 inches. The pallet 62 also typically maintains a polygonal shaped transverse, cross-sectional area over most of its length. Preferably, at least 80 percent of length of the pallet 62 has a polygonal shaped transverse cross-sectional area.

The hardness of the pallet 62 can be varied by selecting harder or softer pallet material. The hardness of the pallet 62 affects the feel of the racquet by making the grip softer and more comfortable to the user, enabling a player to more readily feel by touch the flats 70 and the corners 72, and facilitating the dampening of vibration and shock upon impact with a ball. The pallet 62 is preferably formed of a material having a hardness or a hardness value falling within the range of 20 on a Shore A hardness scale to 50 on a Shore D hardness scale. In one particularly preferred embodiment, the pallet 62 is formed of a material having a hardness falling within the range of 65 to 85 on a Shore A hardness scale. In another particularly preferred embodiment, the pallet 62 is formed of a material having a hardness within the range of 35 to 45 on a Shore A hardness scale. In other preferred embodiments, the pallet can be formed of a material falling within other hardness ranges. In addition, the pallet 62 preferably has a weight within the range of 30 to 40 grams, but in alternative embodiments, other weights can also be used.

The pallet 62 is formed with an outer surface that defines a plurality of longitudinally extending "flats 70", or generally elongate planar surfaces, that are angled with respect to each other such that the outer surface of the pallet 62 defines a generally polygonal-shaped transverse cross-sectional area. The flats 70 have side edges that come together to form elongate corners 72 longitudinally extending along the pallet 62. In one preferred embodiment, the pallet 62 defines eight flats 70 and eight corners 72 and a corresponding generally octagonal transverse cross-sectional area.

In one preferred embodiment, at least two of the flats 70 of the pallet 62 define respective elongate recesses 74. Each recess 74 has a length, width and depth. The length of the recess 74 can extend the entire length of the flat 70. The length of the recess is preferably at least four inches. In alternative preferred embodiments, the length of the recess can extend over a portion of the length of the flat. In another alternative preferred embodiment, the recess can be two or more recesses aligned generally end to end about the length of the flat. The width of recess 74 is preferably less than the width of the flat 70. In this manner, the flat 70 defines a flat plane 76 that extends over the recess 74. The depth of the recess 74 can range from 0.5 mm to 5 millimeters or be within the range of 0.004 to 0.250 inch. In one particularly preferred embodiment, the width of the recess is within the range of within the range of 0.075 to 0.55 inches. In other alternative embodiments, the depth of the recess can vary about its length or width. In still other alternative preferred embodiments, the recesses can be formed in a shape that is curved, staggered, tapered, irregular or combinations thereof. The recess 74 preferably extends over at least fifty percent of the respective flat 70 defining the recess 74. The recesses 74 are configured to receive the support members 64.

The support members 64 are generally planar elongate bodies positioned with the respective recesses 74. Referring to FIG. 3, the support member 64 when positioned within the recess 74 substantially fills the recess 74 such that an outer surface of the support member 64 is aligned with and is coplanar to the flat plane 76. The support members 64 are formed of a durable, generally rigid material, such as a composite material. Alternatively, the support members can be formed of other materials such as, for example, aluminum, other metals, foam materials, wood, a thermoplastic material, a thermoset material, neoprene, rubber, silicon and combinations thereof. In one preferred embodiment, the support members 64 are fixedly secured within a respective recess 74 of the pallet 62 through use of an adhesive. Alternatively, the support members 64 can be secured within a respective recess 74 of the pallet 62 through use of thermal bonding, chemical bonding, fasteners, interference fits, snap-fit connections, and combinations thereof. In another, alternatively preferred embodiment, the support members 64 can be removably and/or replaceably secured to the pallet 62 enabling a user to periodically change, upgrade or otherwise replace the supports members 64 used with a particular pallet.

The hardness of the support member 64 can be varied based upon the desired feel and application of the handle assembly 50 and the hardness of the pallet 62 being used with the support member(s) 64. The support member 64 is preferably formed of a material having a hardness or a hardness value falling within the range of 20 on a Shore A hardness scale to 100 on a Shore D hardness scale. In a particularly preferred embodiment, the support member 64 is formed of a material having a hardness within the range of 70 on a Shore A hardness scale to 90 on a Shore D hardness scale. In other preferred embodiments, the support member can be formed of a material falling within other hardness ranges, or combination thereof. Accordingly, a single racquet assembly 50 could have four support members and the four support members could have the same hardness as, or different hardness values.

The weight of one of the support members 64 preferably is within the range of 0.5 to 5 grams, but in alternative embodiments, other weights can also be used. Collectively, the group of support members 64 on the handle assembly can have a weight within the range of 6 to 16 grams. The support member 64 can be a single piece or a multi-piece structure. The support member 64 can have a length within the range of 3 to 7, a transverse width within the range of 0.075 to 0.55 inches, and a thickness within the range of 0.004 to 0.250 inch.

The support members 64 can be formed in a variety of single colors or in multiple color combinations. Further, the support members 64 can include indicia 78 representative of alphanumeric characters, graphics, specification information, advertising information, source data, trademarks, certification marks and combinations thereof. Specification information may include information such as installation instructions, dimensions, warnings, bar codes, test results and design features. Advertising information may include information such as slogans, product ratings, product attributes and information on related products. The indicia 78 may be single or multi-colored. In a particularly preferred embodiment, the indicia include grip and/or support member replacement recommendations and/or instructions. By placing such grip and/or support member replacement instructions and/or recommendations on the support member 64, underneath the grip 66, the instructions and/or recommendations are not worn away, lost or misplaced.

The use of the support members 64 enables the hardness values of the support members 64 and the pallet 62 to be varied to provide a variety of different and unique handle assembly 50 configurations. Each configuration offering a unique feel for the user. For example, in one particularly preferred embodiment, the material used to form the pallet 62 can have a hardness value that is greater (harder) than the material used to form the support members 64. In another particularly preferred embodiment, the opposite configuration can be used, wherein the material used to form the support members 64 has a hardness value that is greater (harder) than the material used to form the pallet 62. The differential between the hardness of the material used to form the pallet 62 and the material used to form the support members 64 can also be varied to provide different play characteristics and feel.

The support members 64 are preferably spaced apart from each other about the pallet 62. The support members 64 can be configured such that during use one of the support members 64 of the plurality of support members 64 on the pallet 62 of the handle assembly 50 may deflect, flex or move with respect to, or independent of, the other support members 64.

The butt cap 66 is a cup-shaped body that extends over and covers a proximal end 82 of the pallet 62. The butt cap 66 preferably includes a sidewall 84 defining an cavity for receiving the proximal end 82 of the pallet 62. The cavity defined by the sidewall 84 preferably corresponds to the transverse cross-sectional shape formed by the outer surface of the pallet 62. Accordingly, if the pallet 62 forms a generally octagonal transverse cross-sectional shape, the cavity defined by the sidewall 84 will have a generally octagonal shape to extend over and matably receive the proximal end 82 of the pallet 62. The butt cap 66 further includes a back wall 86 that covers the end of the pallet 62 and provide a surface for indicia, such as a trademark or other forms of indicia. When installed onto a racquet 10, the sidewall 84 of the butt cap 66 overlaps the pallet 62 thereby making the proximal end of the grip assembly 50 larger than the remaining portions. The larger proximal end of the grip assembly due to the butt cap 66 is preferred by most players for facilitating the grip and play of the racquet. It also helps prevent the racquet from slipping out of the players hand during play. The butt cap 66 is preferably formed of a lightweight durable plastic material. Alternatively, the butt cap can be formed of other materials, such as nylon, wood, thermoset materials, thermoplastic materials, and combinations thereof.

The grip 68 extends over the outer surface of the pallet 62, the support members 64 and preferably at least a portion of the sidewall 84 of the butt cap 66. The grip 68 is typically secured to the handle assembly 50 through use of a suitable adhesive tape. Alternatively, the grip 68 can be attached to the handle assembly 50 by other means, such as, for example, a conventional fluid adhesive, thermal bonding or mechanical bonding. The grip 68 is an elongate strip of soft, durable material. The grip 68 can be made of a leather, a synthetic leather, a rubber or other thermoset material. The grip 68 is typically spirally or helically wrapped about the outer surface of the pallet 62, the support members 64 and the sidewall 84. In an alternative preferred embodiment, the grip 68 can be formed of a semi-transparent, transparent, semi-translucent or translucent material that enables at least a portion of one or more of the support members 64 to be visible to the user through the grip 68. In an alternative preferred embodiment, the grip 68 can be a tubular member that is slidably connected to the outer surface of the pallet 62, the support members 64 and the sidewall 84.

The flats 70 and corners 72 of the pallet 62 are preferably visible and easily felt by a player while holding the handle assembly 50 with one or both hands. Players often rely on the feel of the flats 70 and/or the corners 72 to orient their grip on the handle assembly 50 during play, and to shift their grip positions during play, without having to look at the handle assembly 50. The present invention facilitates a player's ability to sense or feel the flats 70 and/or the corners 72 of the pallet 62 of the handle assembly 50 and thereby make his or her grip adjustments and re-adjustments more quickly and confidently.

Figure 5A:
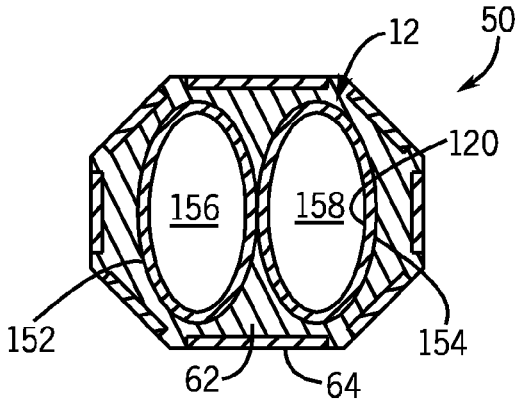
FIG. 5A is a transverse cross-sectional view of a handle assembly of a racquet in accordance with an alternative preferred embodiment of the present invention.

Referring to FIG. 5A, in an alternative preferred embodiment, the shaft 120 can be formed of an aluminum or other metallic alloy. The frame 12 can be formed substantially be a single tubular body that is shaped to form the head or hoop portion of the racquet with first and second ends 152 and 154 drawn together to form part of a throat portion, and then positioned directly adjacent each other to form the shaft 120. The ends 152 and 154 of the tubular body are preferably hollow and define the cavities 156 and 158. In other preferred embodiments, the shaft 120, like the shaft 20, can be formed of the first and second ends 152 and 154 that are separate components from the head portion of the racquet, and can be coupled to the head portion through the use of intermediate pieces such as a throat portion, conventional fasteners, molding techniques, bonding techniques, adhesives or combinations thereof.

Figure 5B:
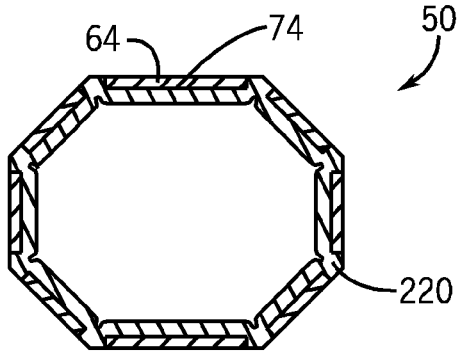
FIG. 5B is a transverse cross-sectional view of a handle assembly of a racquet in accordance with another alternative preferred embodiment of the present invention.

Referring to FIG. 5B, in another alternative preferred embodiment, the shaft 220 can be formed of a composite material about a mandrel or a tube in a shape that approximates the shape of the outer surface of the pallet 62. In the embodiment, the shaft 220 eliminates the pallet. The outer surface of the shaft 220 can have a polygonal transverse cross-sectional shape, such as an octagonal shape, and the recesses 74 can be formed into the outer surface of the shaft 220. The support members 64 are then positioned within the recesses 74 of the shaft 220. The shaft 220 is preferably formed of a composite material, and therefore can be lighter and harder than a typical pallet. Alternatively, the shaft 220 can be formed of other materials, such as, for example, aluminum, a metal, wood, a thermoset material, a thermoplastic material and combinations thereof. The shaft 220 is preferably formed as one integral structure with the frame of the racquet. In other preferred embodiments, the shaft 220, like the shaft 20, can be as a component separate from the head portion of the racquet, and can be coupled to the head portion through the use of intermediate pieces such as a throat portion, conventional fasteners, molding techniques, bonding techniques, adhesives or combinations thereof.

Figure 6A:
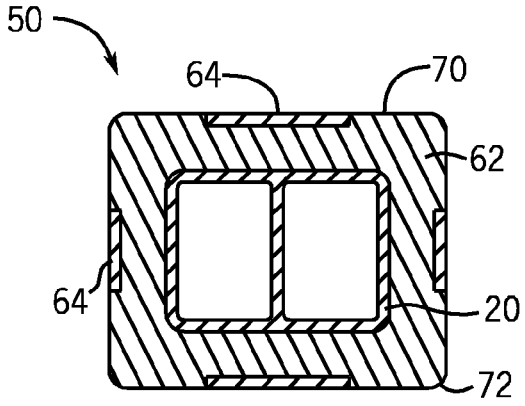
FIGS. 6A through 6C are transverse cross-sectional views of handle assemblies of racquets in accordance with additional alternative preferred embodiments of the present invention.
Figure 6B:
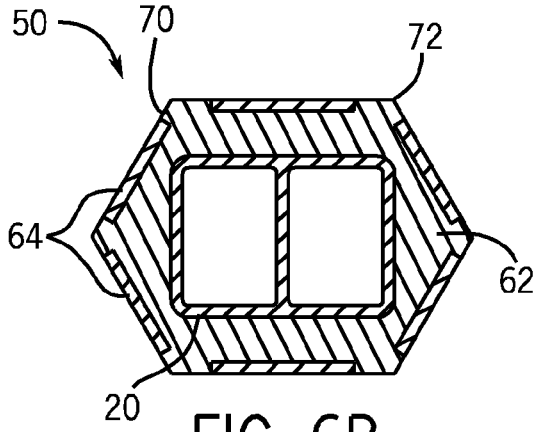
Figure 6C:
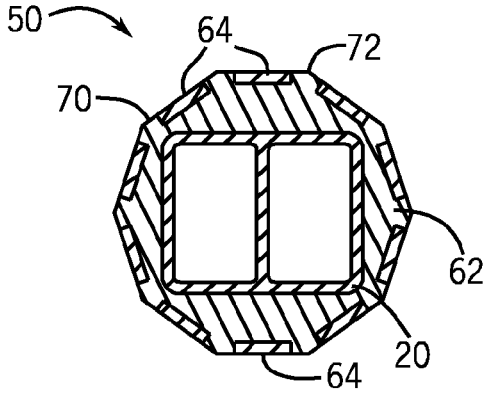

Referring to FIGS. 6A, 6B and 6C, the outer surface of the pallet 62 can be formed in a variety of different polygonal transverse cross-sectional shapes. In FIG. 6A, the outer surface of the pallet 62 is formed with a generally rectangular transverse cross-sectional shape. Accordingly, the pallet 62 can be formed with four flats 70 and four corners 72. In FIG. 6B, the outer surface of the pallet 62 is formed with a generally hexagonal transverse cross-sectional shape. Accordingly, the pallet 62 can be formed with six flats 70 and six corners 72. Further, in FIG. 6C, the outer surface of the pallet 62 is formed with a generally decagonal transverse cross-sectional shape. Accordingly, the pallet 62 can be formed with ten flats 70 and ten corners 72. In other alternative preferred embodiments, the outer surface of the pallet 62 can be shaped to form other polygonal transverse cross-sectional shapes or other shapes. The handle assemblies 50 of FIGS. 6A, 6B and 6C can be constructed in a similar manner to the handle assembly of FIGS. 1 through 4.

Figure 7A:
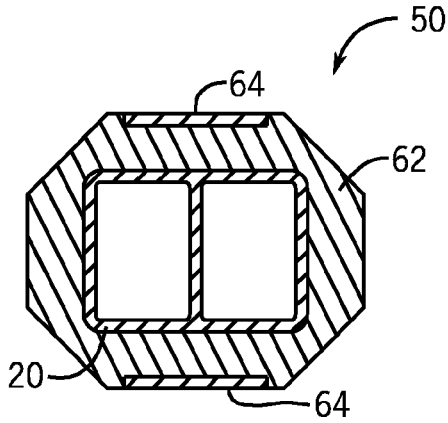
FIGS. 7A through 7C are transverse cross-sectional views of handle assemblies of racquets in accordance with additional alternative preferred embodiments of the present invention.
Figure 7B:
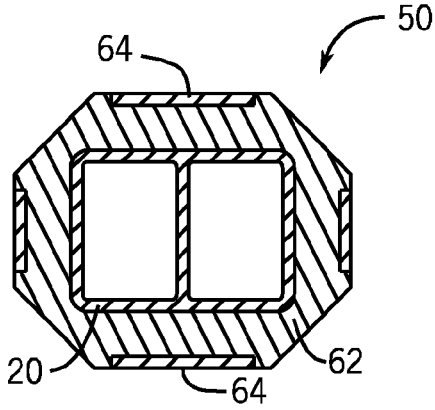
Figure 7C:
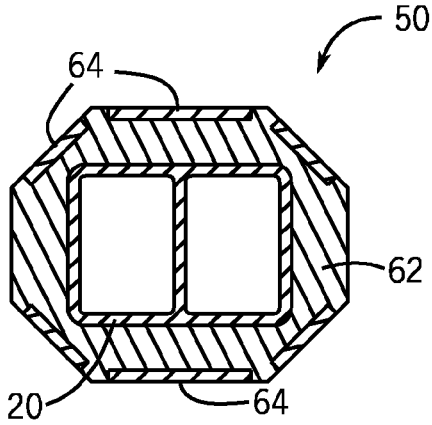

Referring to FIGS. 7A, 7B and 7C, the pallet 62 of the handle assembly 50 can be formed with an octagonal transverse cross-sectional shape and therefore has eight flats 70 and eight corners 72. The handle assemblies 50 of FIGS. 7A, 7B and 7C have two, four or six recesses 74 respectively out of the eight flats 70 of the pallet 62. The preferred embodiments of FIGS. 7A, 7B and 7C illustrate that the present invention contemplates that the handle assembly can be formed with two, four and six recesses filled with two, four and six support members in an eight sided (eight flat) pallet. The present invention, also contemplates that other numbers of recesses and support members can be used on an eight sided pallet or on pallets having other numbers of flats.

Figure 8A:
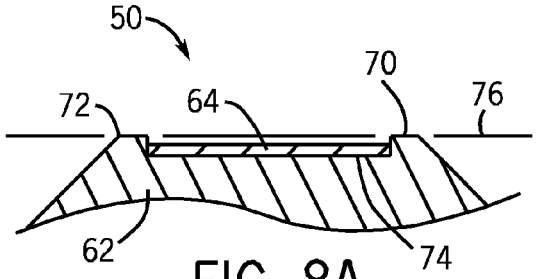
FIGS. 8A and 8B are transverse sectional views of a portion of handle assemblies in accordance with additional alternative preferred embodiments of the present invention.
Figure 8B:
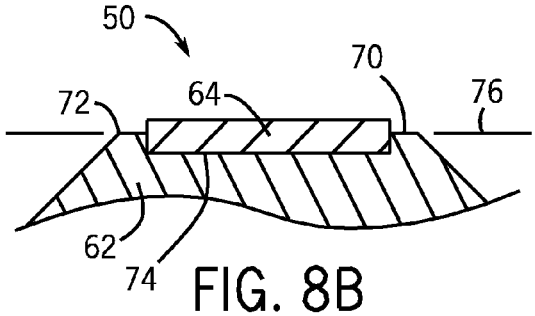

Referring to FIGS. 8A and 8B, a portion of a transverse cross-sectional view of the handle assembly 50 is shown wherein the recess 74 is formed in the flat 70 of the pallet 62. The flat 70 defines the flat plane 76. In the preferred embodiment, of FIG. 8A, the support member 64 is positioned within the recess 74 and has a depth that is less than the depth of the recess 74 such that the outer surface of the support member 64 is recessed with respect to the flat plane 76. Referring to FIG. 8B, in another preferred embodiment, the support member 64 is positioned with the recess 74, substantially fills the recess 74, and outwardly projects beyond the recess 74. Accordingly, at least a portion of the support member 64 extends beyond the flat plane 76. It is contemplated that the support member 64 can partially fill the recess 74, substantially fill the recess such that the support member 64 is generally aligned with the flat plane 76, and/or at least a portion of the support member 64 can extend beyond the recess 74 and beyond the flat plane 76. These configurations along with varying the material and/or hardness of the support members 64 and/or the pallet 62 enable a wide variety of different handle assembly embodiments to be used, each one offering a unique feel. The large variety of embodiments also enables different embodiments to be developed for different applications, different player types, and/or different player skill levels.

Figure 9:
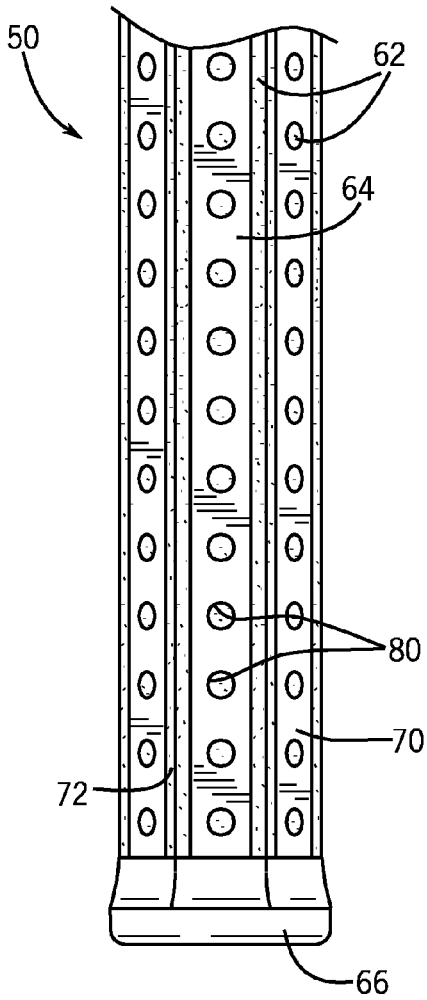
FIG. 9 is a front view of a handle assembly of a racquet in accordance with another alternative preferred embodiment of the present invention.

Referring to FIG. 9, in another alternative preferred embodiment, one or more of the support members 64 can be formed with one or more apertures 80. The apertures 80 are preferably through-wall (or entirely through the thickness of the support member) and circular. In alternative embodiments, the apertures can have other shapes, such as, for example, polygonal, oval, irregular and combinations thereof. The material of the pallet 62 can be configured to extend into and through the aperture 80 to be even with or approximate to the outer surface of the support member.

Figure 10:
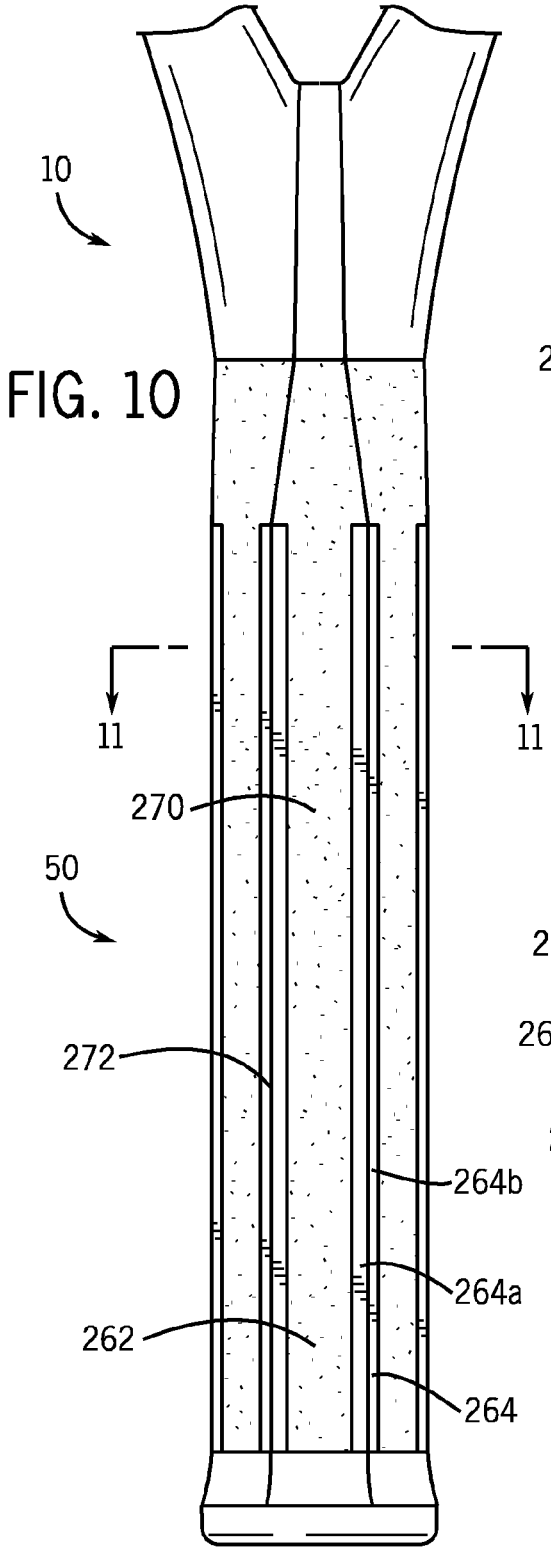
FIG. 10 is a front view of a handle assembly of a racquet in accordance with another alternative preferred embodiment of the present invention.
Figure 11:
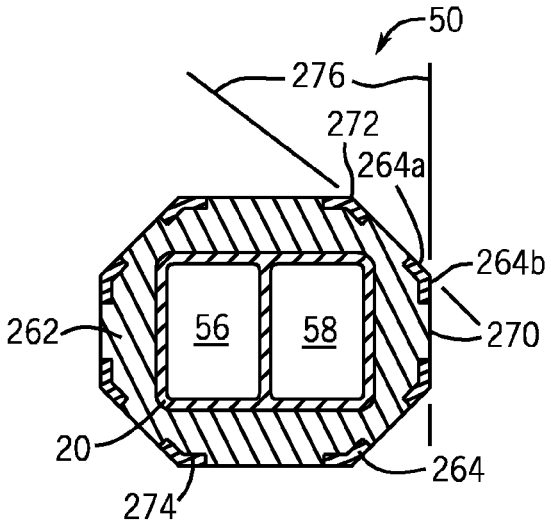
FIG. 11 is a transverse cross-sectional view of handle assemblies of racquets taken along line 11-11 of FIG. 10.

Referring to FIGS. 10 and 11, an alternative preferred embodiment of the handle assembly 50 is illustrated. The handle assembly embodiment of FIGS. 10 and 11 is substantially similar to the previously described embodiments, with the exception of the configuration of the pallet and the support members. A pallet 262 has similar material, shape, size and hardness configurations as the embodiments described above for the pallet 62. However, the pallet 262 defines a plurality of recesses 274 that are positioned and configured differently than the recesses 74 defined by the pallet 62. The pallet 262 defines a polygonal transverse cross-sectional area, including for example, an octagonal transverse cross-sectional area. The pallet 262 generally defines a plurality of flats 270 and a plurality of corners 272 similar to the flats 70 and the corners 72. Each of the flats 270 defines a flat plane 276. The recesses 274 are longitudinally positioned along a plurality of the corners 272 and extend about a portion of the adjacent flats 270. In a particularly preferred embodiment, the recess 274 transversely extends a distance of approximately 3 mm into each of the adjacent flats 270 from the corner 272. Alternatively, alternative distances can be used, such as, for example, distances falling within the range of 0.5 mm to 7 mm. The depth and length of the recess 274 can be configured to be similar to the depth and length of the recess 74. The recess 274 is shaped and configured to receive one or more support members 264.

The support member 264 is substantially similar to the support member 64, with the exception of its shape and position on the handle assembly 50. The support member 264 is configured to at least partially fill the recess 274. The support member 264 can be one or more pieces and can be configured extends over and along the corner 272 of the handle assembly 50. The support member 264, if formed as one-piece or collectively as two or more pieces, preferably has a generally V-shaped transverse cross-sectional area that generally conforms to the shape of the recess 274. Accordingly, the support member 264 is shaped and configured to extend over and along the longitudinally extending corner 272, and then extend into the adjacent flat 270. The support member 264 can be configured to have first and second planar outer surfaces 264*a* and 264*b* with corresponding widths that extend in each direction from the corner 272 by an amount within the range of 0.5 to 7 mm. The first and second planar outer surfaces 264*a* and 264*b* are angled with respect to each other. In one particularly preferred embodiment, the width of the first and second planar outer surfaces 264*a* and 264*b* of the support member 264 extend away from the corner 272 is approximately 3 mm in both directions from the corner 272. The V-shaped transverse cross-sectional area of the support member 264 corresponds to the shape of the recess 274 and is angled by an amount that corresponds to the angle of the recess 274 in the pallet. Accordingly, the angle of the corner 272 and the angle of the transverse cross-sectional area of the support member 264 will vary depending upon if the recess is formed on an octagonal handle assembly or a handle assembly of another polygonal shape or other shape. The support member 264 is positioned within the recess 274 and substantially fills the recess 274 such that the first and second planar outer surfaces 264*a* and 264*b* are generally coplanar with their respective flats 270.

Figure 12:
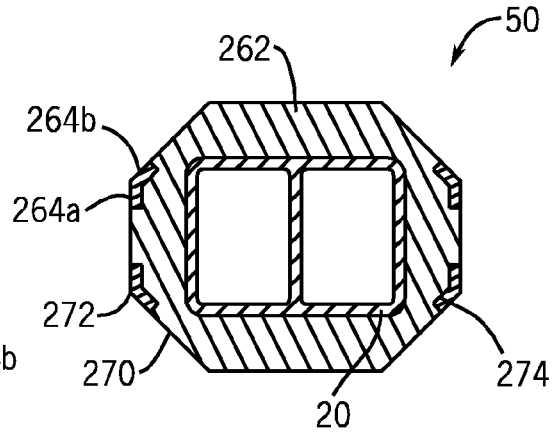
FIG. 12 is a transverse cross-sectional view of a handle assembly of a racquet in accordance with an additional alternative preferred embodiment of the present invention.

Referring to FIG. 12, the pallet 262 of the handle assembly 50 can be formed with an octagonal transverse cross-sectional shape and therefore has eight flats 270 and eight corners 272. The handle assembly 50 of FIG. 12 has four recesses 74 respectively out of the eight flats 70 of the pallet 62. The preferred embodiment of FIG. 12 illustrates that the present invention contemplates that the handle assembly can be formed with four recesses filled with four support members in an eight sided (eight flat) pallet. The present invention, also contemplates that other numbers of recesses and support members can be used on an eight sided pallet or on pallets having other numbers of flats. Accordingly, the handle assembly could have an octagonal cross-sectional shape and have one, two, three, five, six or seven recesses and corresponding support members. Each of the corresponding support members could be a one piece structure or a multi-piece structure.

Figure 13A:
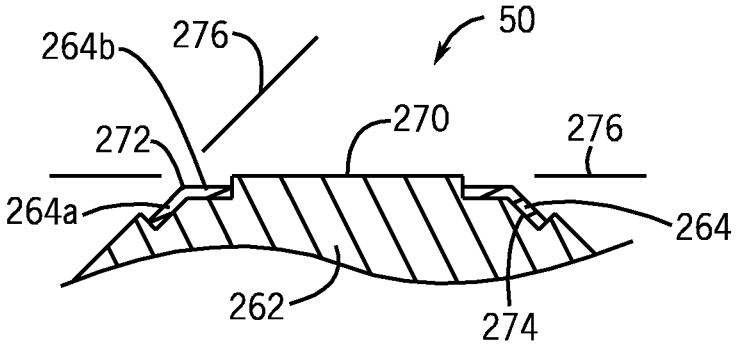
FIGS. 13A and 13B are transverse sectional views of a portion of a handle assemblies in accordance with additional alternative preferred embodiments of the present invention.
Figure 13B:
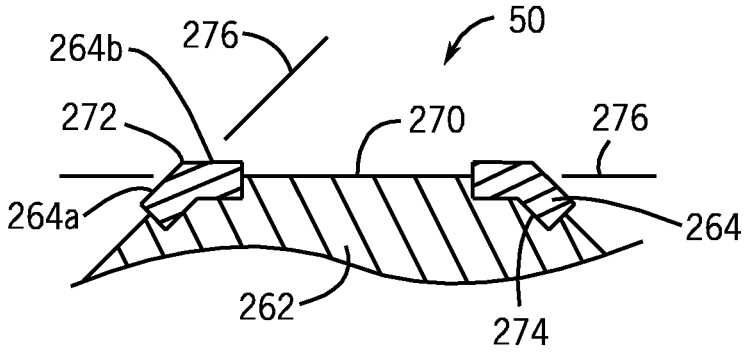

Referring to FIGS. 13A and 13B, a portion of a transverse cross-sectional view of the handle assembly 50 is shown wherein the recess 274 is formed in the flat 270 of the pallet 62. In the preferred embodiment, of FIG. 13A, the support member 264 is positioned within the recess 274 and has a depth that is less than the depth of the recess 274 such that the first and second planar outer surfaces 264*a* and 264*b* of the support member 64 are recessed with respect to the respective flat planes 276. Referring to FIG. 13B, in another preferred embodiment, the support member 264 is positioned with the recess 274, substantially fills the recess 274, and outwardly projects beyond the recess 274. Accordingly, at least a portion the first and second planar outer surfaces 264*a* and 264*b* of the support member 264 extend beyond the respective flat planes 276. It is contemplated that the support member 264 can partially fill the recess 274, substantially fill the recess such that the support member 264 is generally aligned with the respective flat plane 276, and/or at least a portion of the support member 264 can extend beyond the recess 274 and beyond the respective flat planes 276. These configurations along with varying the material and/or hardness of the support members 264 and/or the pallet 262 enable a wide variety of different handle assembly embodiments to be used, each one offering a unique feel. The large variety of embodiments also enables different embodiments to be developed for different applications, different player types, and/or different player skill levels.

The present invention allows for a wide range of potential arrangements and configurations of handle assemblies, thereby maximizing the flexibility of the racquet design and allowing the racquet to be customized or tailored to meet the needs of a particular player or type of player. The present invention enables the handle assembly to reduce the shock and/or vibration felt by the user while enabling the user retain sufficient feel to properly, confidently and effectively properly grip the racquet, and reposition his or her grip of the racquet during play.

While the preferred embodiments of the present invention have been described and illustrated, numerous departures therefrom can be contemplated by persons skilled in the art. Therefore, the present invention is not limited to the foregoing description but only by the scope and spirit of the appended claims.

What is claimed is:

1. A sports racquet comprising:

a head portion; and a handle assembly coupled to and longitudinally extending from the head portion, the handle assembly including an elongate tubular shaft, a pallet positioned over the shaft and having an outer surface that defines a plurality of longitudinally extending flats, each of the flats having a length and a width, at least two of the flats defining respective elongate recesses, each of the recesses having a maximum recess width that is less than the width of the respective flat, the pallet being formed of at least a first material having a first hardness value on a Shore hardness scale, and a plurality of generally planar support members coupled to the shaft and positioned within the respective recesses, the support members being formed of at least a second material having a second hardness on a Shore hardness scale, the second hardness value being greater than the first hardness value indicating that the second material is harder than the first material.

2. The racquet of claim 1, wherein the plurality of longitudinally extending flats are selected from the group of four flats, six flats, eight flats and ten flats.

3. The racquet of claim 2, wherein at least 50 percent of the flats define elongate recesses.

4. The racquet of claim 1, wherein the plurality of longitudinally extending flats is eight flats, and wherein six of the eight flats define the respective elongate recesses.

5. The racquet of claim 1, wherein the plurality of longitudinally extending flats is eight flats, and wherein all eight of the flats define the respective elongate recesses.

6. The racquet of claim 1, wherein the planar support members positioned within the recesses substantially fill the recesses such that the outer surface of the support members is generally coplanar with the respective flat.

7. The racquet of claim 1, wherein the planar support members positioned within the recesses partially fill the recesses such that at least a portion of the outer surface of the support members remains recessed with respect to a plane defined by the respective flat.

8. The racquet of claim 1, wherein the planar support members positioned within the recesses substantially fill the recesses and at least a portion of the planar support member outwardly projects from a plane defined by the respective flat.

9. The racquet of claim 1, wherein the first material and the second material are different materials.

10. The racquet of claim 1, wherein the first hardness value is within the range of 35 to 45 on the Shore A hardness scale.

11. The racquet of claim 1, wherein the first hardness value is within the range of 65 to 85 on the Shore A hardness scale.

12. The racquet of claim 1, wherein the pallet has a weight within the range of 30 to 40 grams, and the plurality of support members have a collective weight within the range of 6 to 16 grams.

13. The racquet of claim 1, wherein the second hardness value is within the range of 20 to 100 on the Shore D hardness scale.

14. The racquet of claim 1, wherein the first material is selected from the group consisting of a polyurethane foam, other cellular foam materials, non-cellular foam materials, wood, a thermoplastic material, a thermoset material, neoprene, rubber, silicon, a composite material, a metal and combinations thereof.

15. The racquet of claim 1, wherein the second material is selected from the group consisting of a fiber composite material, aluminum, other metals, foam materials, wood, a thermoplastic material, a thermoset material, neoprene, rubber, silicon, a composite material and combinations thereof and combinations thereof.

16. The racquet of claim 1 wherein the planar support members planks have a length of at least 4 inches and each of the recesses has a length of at least 4 inches.

17. The racquet of claim 1, further comprising a grip positioned over the pallet and the support members.

18. The racquet of claim 17, wherein the grip is formed of a material that is transparent, semi-transparent, translucent or semi-translucent.

19. The racquet of claim 1, wherein at least one of the support members includes graphical and/or alpha-numeric indicia.

20. The racquet of claim 1, wherein the plurality of support members are removably coupled to the pallet.

21. The racquet of claim 1, further comprising a butt cap positioned over a proximal end of the handle portion.

22. The racquet of claim 1, wherein at least one of the support members has a length within the range of 3 to 7 inches, a transverse width within the range of 0.075 to 0.55 inch, and a thickness within the range of 0.010 to 0.250 inch.

23. The racquet of claim 1, wherein the plurality of support members includes at least first and second support members, and wherein during use the first support member may deflect independently of the second support member.

24. The racquet of claim 1, wherein at least one of the support members includes a plurality of openings extending through the support member.

25. A handle assembly for a sports racquet, the handle assembly comprising:

an elongate tubular shaft formed of a fiber composite material, a pallet positioned over the shaft and having an outer surface that defines at least four longitudinally extending flats, each of the flats having a width and a length, at least four of the flats defining respective elongate openings, each of the openings having a length and a maximum width, the maximum width of each of the openings being less than the width of the respective flat, the pallet being formed of at least a first material having a first hardness value on a Shore hardness scale, and at least four planar support members positioned within the respective openings, the support members being formed of the fiber composite material, the fiber composite material having a second hardness on a Shore hardness scale, the second hardness value being greater than the first hardness value indicating that the second material is harder than the first material, the at least four planar support members defining at least a portion of the outer surface of the handle assembly.

26. The racquet of claim 25, wherein the openings have a depth within the range 0.5 to 5.0 mm.

* * * * *